US005111705A

United States Patent [19]

Isozumi

[11] Patent Number: 5,111,705

[45] Date of Patent: May 12, 1992

[54] STARTER MOTOR

[75] Inventor: Shuzou Isozumi, Himeji, Japan

[73] Assignee: Mitsubishi Denki Kabushiki Kaisha, Tokyo, Japan

[21] Appl. No.: 534,911

[22] Filed: Jun. 8, 1990

[30] Foreign Application Priority Data

Jun. 22, 1989 [JP] Japan ..... 1-162344

[51] Int. Cl.[5] ..... F02N 15/06

[52] U.S. Cl. ..... 74/6; 74/7 R; 74/7 C

[58] Field of Search ..... 74/6, 7 R, 7 C

[56] References Cited

U.S. PATENT DOCUMENTS 4,592,243 6/1986 Katoh et al. ..... 74/7 R X
4,808,836 2/1989 Isozumi et al. ..... 74/6 X

FOREIGN PATENT DOCUMENTS 1311876 11/1962 France .
52773 11/1982 Japan .

*Primary Examiner*—Leslie A. Braun
*Assistant Examiner*—Daniel Wittels
*Attorney, Agent, or Firm*—Sughrue, Mion, Zinn, Macpeak & Seas

[57] ABSTRACT

A starter motor is adapted to transmit through an overrunning clutch device a rotating force of an armature to a rotary output shaft to which a pinion is fitted by means of a linear spline structure so that the pinion is engageable with a ring gear connected to an engine. The rotary output shaft has a shoulder portion between a helical spline portion, which is engaged with a helical spline which in turn is formed at the inner circumference of the front part of a clutch inner member in the overrunning clutch device, and a linear spline portion to which the pinion is fitted, and a spring is disposed inside the inner diameter of the heical spline of the clutch inner member and between the helical spline of the rotary output shaft and the rear end of the pinion so that the pinion is pushed forwardly wherein the shoulder portion has a diamter smaller than the diameter of the root of the helical spline of the rotary output shaft.

3 Claims, 3 Drawing Sheets

STARTER MOTOR

BACKGROUND OF THE INVENTION

1. Field of the Invention

The present invention relates to a starter motor for starting an internal combustion engine mounted on, for instance, an automobile. More particularly, it relates to a miniaturized and weight-saving starter motor of an overhang type wherein a pinion is fitted to a rotary output shaft by means of a linear spline structure.

2. Discussion of Background

There has been known a starter motor of an overhang type which facilitates attachment to a vehicle engine. In particular, there has been proposed a starter motor called a coaxial type starter wherein a motor section and an electromagnetic switch device are arranged in the same axial line so that a rotary output shaft fitted with a pinion is slidably moved in the axial direction. FIG. 3 is a cross-sectional view showing such a conventional starter motor disclosed in, for instance, Japanese Unexamined Patent Publication No. 90665/1988. In FIG. 3, "front" means the right side of each structural element shown in drawings and "rear" means the left side of the structural elements.

A reference numeral 1 designates an armature as a major element of a starter motor 100, which is mainly composed of an armature core 2 and a tubular armature rotary shaft 3 having a central bore 3*a*. An armature core 2 is attached to an intermediate portion of the armature rotary shaft 3 and a commutator 4 is fitted to the rear part of the rotary shaft 3. The commutator 4 is connected to an armature coil 5 which is wound in the armature core 2.

A numeral 6 designates an assembly consisting of brushes and holders arranged at the outer circumference of the commutator 4. A rear bracket 7 for a D.C. motor holds the assembly of brushes and holders 6 at the inside of the rear end portion by means of bolts. The rear bracket 7 is provided with a bearing aperture 7*a* extending in the axial direction at the central portion of the rear end, which is formed by bending inwardly along the axial direction. A bearing 8 is fitted to the bearing aperture 7*a* so as to support the rear end portion of the armature rotary shaft 3. A yoke 9 which is a part of the D.C. motor has its rear end in contact with the front end of the rear bracket 7 and attached at its inner circumferential surface with a plurality of permanent magnets 9*a* for producing a magnetic field to the armature. There is formed a annular shoulder portion at the outer circumference of the front end surface of the yoke, and a front bracket 10 having the corresponding annular shoulder portion at its rear end is fitted to the yoke 9. The front bracket 10 has an internal gear wheel 10*a* which constitutes a part of a planetary reduction gear device.

The inner diameter portion of the front bracket 10 is stepwisely reduced from the rear part to the front part to thereby form a plurality of annular shoulder portions. The front bracket 10 has also a recess for bearing 10*b* at the intermediate shoulder portion and the smallest diameter portion 10*c* formed at the front end, as well as the internal gear wheel at the rear portion of it. A sun gear wheel 11 as a flat gear wheel is formed at the outer circumference of the front end portion of the armature rotary shaft 3. Planetary gear wheels 12 are positioned between the sun gear wheel 11 and the internal gear wheel 10*a* to be meshed with the both gear wheels. A bearing 13 is fitted to the outer circumference of a support pin 14 which supports each of the planetary gear wheels 12.

An overrunning clutch 15 comprises a clutch inner member 15A having a helical spline teeth 15 which are formed at the inner circumferential surface at the portion near the D.C. motor and a reduced diameter portion 15*b* at its front portion, a clutch outer member 15B for supporting the support pins 14 at its rear part, which is disposed so as to be connectable to or detachable from the clutch inner member 15A, and rollers 15C arranged between the clutch inner member 15A and the clutch outer member 15B. A bearing 16 is fitted to the intermediate reduced diameter portion 10*b* of the front bracket 10 so as to bear a radial load of the clutch inner member 15A.

A rotary output shaft 17 is provided with a recess 17*a* at the rear end surface and spline teeth 18 at an intermediate portion, which diameter is larger than the inner diameter of the front end portion of the armature rotary shaft 3. The spline teeth 18 are fitted to the helical spline teeth 15*a* of the clutch inner member 15A so as to be able to move in the axial direction. A spring 19 is interposed between a shoulder portion formed in the vicinity of the front end of the spline teeth 18 and the rear end of the reduced diameter portion 15*b* so as to push the rotary output shaft 17 backwardly. A pinion 20 is attached to the front end portion of the rotary output shaft 17 by means of a straight spline structure 21 formed at the front portion. A stopper 22 is formed at the front end of the rotary output shaft 17 so that it retains the pinion 20 to the rotary output shaft 27 because the pinion 20 is pushed forwardly by a sping 20*b* which is interposed between a recess 20*a* formed at the rear portion of the pinion and an annular shoulder portion formed in the outer circumference of the rotary output shaft 17. The spring 20*b* is to move the pinion 20 backwardly along the axial line when the stopper 22 and a ring 22*b* are attached to the rotary output shaft 17 after the pinion 20 has been fitted to the rotary output shaft 17. Namely, the spring 20*b* functions to push the pinion 20 forwardly in a space which allows the movement of the pinion 20 in the backward direction after the pinion 20 has been assembled. The spring 20*b* also serves to reduce a shock when the pinion 20 is engaged with the ring gear of the engine. In FIG. 3, a character T denotes the thickness of the bottom portion of the pinion 20.

A sleeve bearing 23 is fitted to the inner circumferential surface of the central bore 3*a* of the armature rotary shaft 3 to thereby support the rear portion of the rotary output shaft 17 inserted from the front end portion of the central bore 3*a* so that the rotary output shaft 17 can be rotated and moved linearly in the axial direction. A bearing 24 is fitted to a bearing hole formed at the central portion of the front end of the yoke 9 so that it supports the armature rotary shaft 3 between the armature core fitting portion and the sun gear wheel 11.

An electromagnetic switch 25 is attached to the rear part of the armature 1 which is a part of a starter motor so as to provide a thrust force to the rotary output shaft 17 when the electromagnetic switch is excited. The electromagnetic switch 25 comprises a casing 26 having an opening at its front side which is firmly attached to the rear end of the rear bracket 7, a bobbin 27 with an axial opening which is positioned in alignment with the axial direction of the starter motor 100 and which is received in the casing 26, an exciting coil 28 wound around the bobbin 27 and a plunger 29 made of a ferromagnetic material which is disposed in the central aperture of the bobbin 27 so as to be movable in the axial direction, has a recess whose bottom is provided with an opening 29*a* which opens toward the starter motor 100, and a shoulder portion 29*b* at the outer circumferential surface. The electromagnetic switch 25 further comprises a core 30 having a bearing hole 30*a* at its central portion, which is fitted to the inner circumferential surface of the opening of the casing 26 wherein the core 30 has a shoulder portion for receiving the bobbin 27, a return spring 31 interposed between the core 30 and the shoulder portion 29*a* to push the plunger 29 backwardly, and a plunger rod 32 having a T-like shape in longitudinal cross section which has the front portion inserted in the central bore 3*a* from the rear end of the armature rotary shaft 3 wherein the plunger rod 32 is in alignment with the rotary output shaft 17 and is in contact with it through a steel ball 33 placed in the recess 17*a* formed at the rear end surface of the rotary output shaft 17; an intermediate portion of the plunger rod 32 is born by a bearing 34 fitted to the bearing hole 30*a* of the core 30, the rear end portion of the plunger rod 32 is disposed in a space which is opposite the motor 1 with respect to the core 30, and a spring 35 is arranged in the recess of the plunger 29 so as to push the plunger rod forwardly.

A movable contact (not shown) is attached to the plunger 29 through an insulating material, and a fixed contact (not shown) is attached to the casing 26 through an insulating material so as to oppose the movable contact. A lead wire (not shown) connects the movable contact to a positive terminal of a D.C. power source, while a negative terminal of the assembly of brushes and holders 6 is grounded. The positive terminal of the assembly is connected to the fixed contact by means of a lead wire. The exciting coil 28 is connected to the D.C. power source through a starter switch (not shown).

The operation of the conventional starter motor will be described. In a state that the starter switch is opened, the exciting coil 28 is not excited, whereby only the force of the spring 31 is applied to the plunger 29. Accordingly, the plunger 29, i.e. the plunger rod 32 is positioned at the rearmost position. Then, the rotary output shaft 17 does not receive the thrust force from the electromagnetic switch, so that the rotary output shaft 17 is brought to the rear position where the front end surface of the armature rotary shaft 3 comes in contact with the rear side of the spline teeth 18 by the action of the spring 19. (The position shown in FIG. 3). The front end of the plunger rod 32 of the electromagnetic switch 25 is in contact with the steel ball 33 so that the ball 33 does not come out from the recess 17*a* of the rotary output shaft 17. Naturally, the armature 1 is in a non-conductive state and is stopped.

By operating the starter switch, a current flows the exciting coil 28 of the electromagnetic switch 25, and the plunger 29 is moved forwardly by an electromagnetic force produced by the excitation of the exciting coil 28. Then, the movable contact is brought into contact with the fixed contact and a current flows into the brushes of the brush and holder assembly 6. The current flows from the commutator 4 to the ground via the armature coil 5. Thus, a rotating force is produced in the armature 1 by the current conduction to the armature 1. The rotating force is transmitted to the planetary gear wheels 12 through the sun gear wheel 11. The rotating force causes the revolution of the planetary gear wheels 12. A force produced by the revolution of the planetary gear wheels 12 is transmitted to the overrunning clutch 15. The revolution transmitted to the overrunning clutch 15 is transmitted to the helical spline teeth 18 through the helical spline teeth 15*a* of the clutch inner member 15A which is engaged with the clutch outer member 15B through the rollers 15*c*, whereby the rotary output shaft 17 is rotated along with the pinion 20 at a predetermined reduction ratio with respect to the rotation of the armature 1.

On the other hand, when the plunger 29 is pushed forwardly, i.e., the plunger rod 32 is pushed forwardly, the rotary output shaft 17 which receives a thrust force from the plunger rod 32 through the steel ball 33 is moved forwardly along with the pinion 20 against the spring force of the spring 19. At this moment, the spline teeth 18 move forwardly while they are engaged with the spline teeth 15*a* so that the relative position of engagement is changed.

The pinion 20 is projected forwardly from the reduced diameter portion 10*c* due to the forward movement of the rotary output shaft 17 and is engaged with the ring gear formed at the outer circumference of a flywheel which is attached to the engine. Thus, the rotating force of the armature 1 is transmitted to the ring gear at a reduced speed obtained by a pinion structure, whereby the engine is started.

As soon as the engine is started, the rotating force of the engine is transmitted to the pinion 20 through the ring gear and the rotary output shaft 17 is rotated with the pinion 20. When a speed of rotation of the rotary output shaft 17 reaches a predetermined value, the overrunning clutch 15 separates from the rotary output shaft by the action of the rollers 15*c*, whereby the pinion 20 and the rotary output shaft 17 rotate freely.

After the engine has been started, the starter switch is operated to be an OFF position, and then the rotary output shaft 17 is returned to the position (as shown in FIG. 3) by the returning force of the returning spring 19 without receiving any thrust force from the electromagnetic switch 25; thus, the starter is returned to the initial state (as shown in FIG. 3).

In the conventional starter motor of an overhang type, such as a coaxial type starter, a spring 20*b* is interposed between a shoulder portion formed in the rotary output shaft and at the radially outer portion of the straight spline structure formed in the rotary output shaft and the reduced diameter portion formed in a recess formed in the inner diameter portion of the pinion, whereby the pinion is pushed forwardly. Accordingly, in order to satisfy that the pinion should have a strength which is determined by the thickness T of the bottom portion of the pinion and the rotary output shaft should have a predetermined strength, it was necessary that the number of teeth of the pinion should be a predetermined number or greater. Namely, it was necessary that the diameter of the pinion is a predetermined value or greater. In $D_p10$ (M=2.54 in module) which has been generally used for ring gears and pinions for automobiles, the minimum value is 8.

On the other hand, the volume of the armature of a motor is in inverse proportion to the gear ratio of a pinion to a ring gear. There has been a demand of reducing the volume of the armature, i.e., miniaturizing or reducing the weight of the motor by increasing the gear ratio between the pinion and the ring gear while the number of teeth of the ring gear should have a predetermined value and the number of teeth of the pinion should be reduced. However, it was impossible to reduce the number of teeth of the pinion because of the reason described above.

In the conventional coaxial type starter, however, it was difficult to reduce the length in the axial direction of the starter because the electromagnetic switch is attached to the rear of the motor, owing to the same reason described above.

In the conventional starter motor, the helical spline structure constitutes a supporting point to a load applied to the rotary output shaft. Accordingly, the span between the pinion and the supporting point was inevitably long and the rotary output shaft was apt to incline, whereby there were problems of occurrence of noises and the weakening of the strength of the shaft.

SUMMARY OF THE INVENTION

It is an object of the present invention to provide a starter motor capable of reducing the number of teeth of the pinion, of providing a stable support to the rotary output shaft and of reducing the size and weight of the motor.

The foregoing and other objects of the present invention have been attained by producing a starter motor adapted to transmit through an overrunning clutch device a rotating force of an armature to a rotary output shaft to which a pinion is fitted by means of a linear spline structure so that the pinion is engageable with a ring gear connected to an engine, wherein the rotary output shaft has a shoulder portion between a helical spline portion, which is engaged with a helical spline which in turn is formed at the inner circumference of the front part of a clutch inner member in the overrunning clutch device, and a linear spline portion to which the pinion is fitted, said shoulder portion having a diameter smaller than the diameter of the root of the helical spline of the rotary output shaft, and a spring is disposed inside the inner diameter of the helical spline of the clutch inner member and between the helical spline of the rotary output shaft and the rear end of the pinion so that the pinion is pushed forwardly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
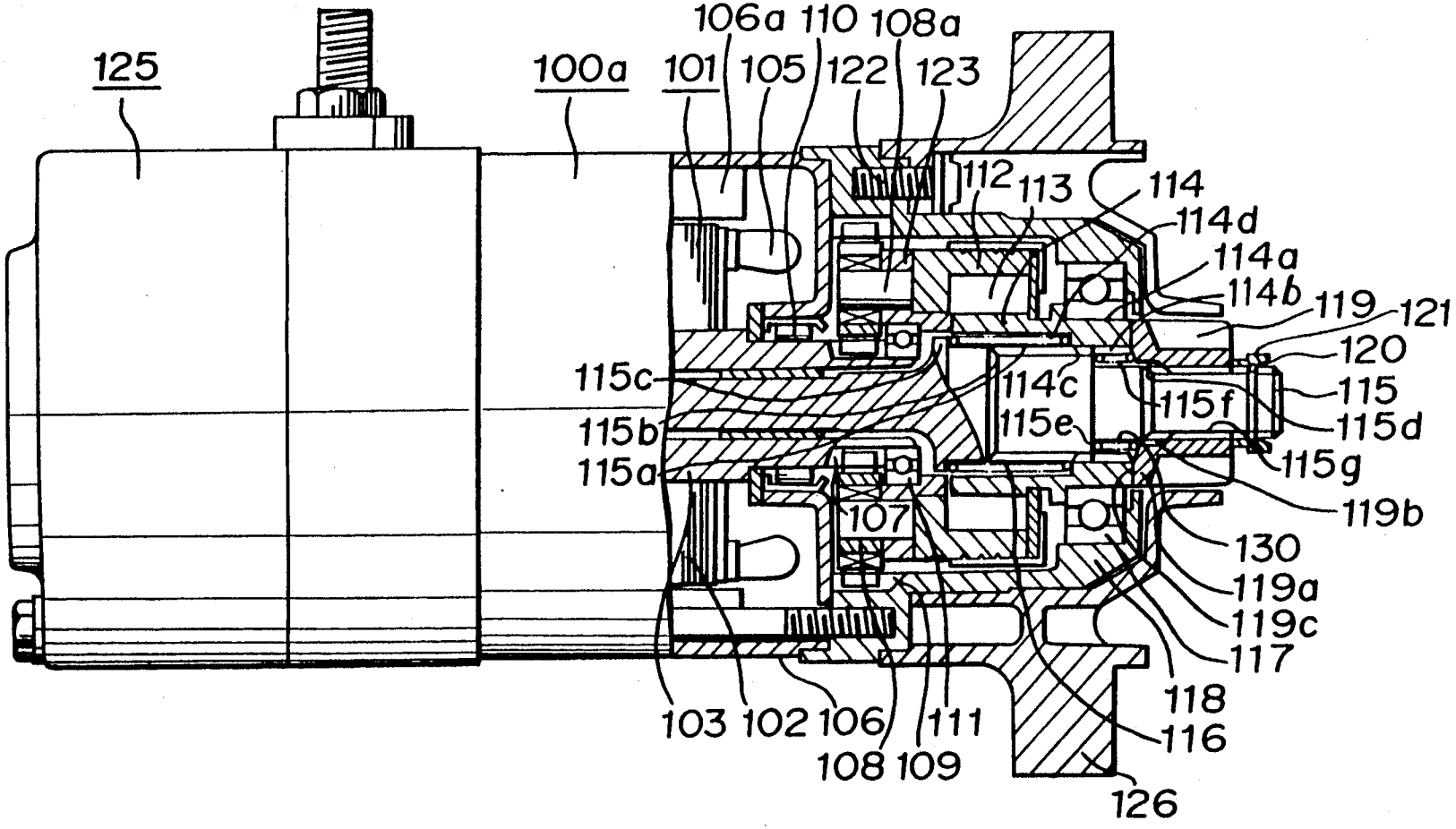
FIG. 1 is a front view partly cross-sectioned in the longitudinal direction of an embodiment of the starter motor according to the present invention.

Referring to the drawings, a preferred embodiment of the starter motor of the present invention will be described.

Figure 3:
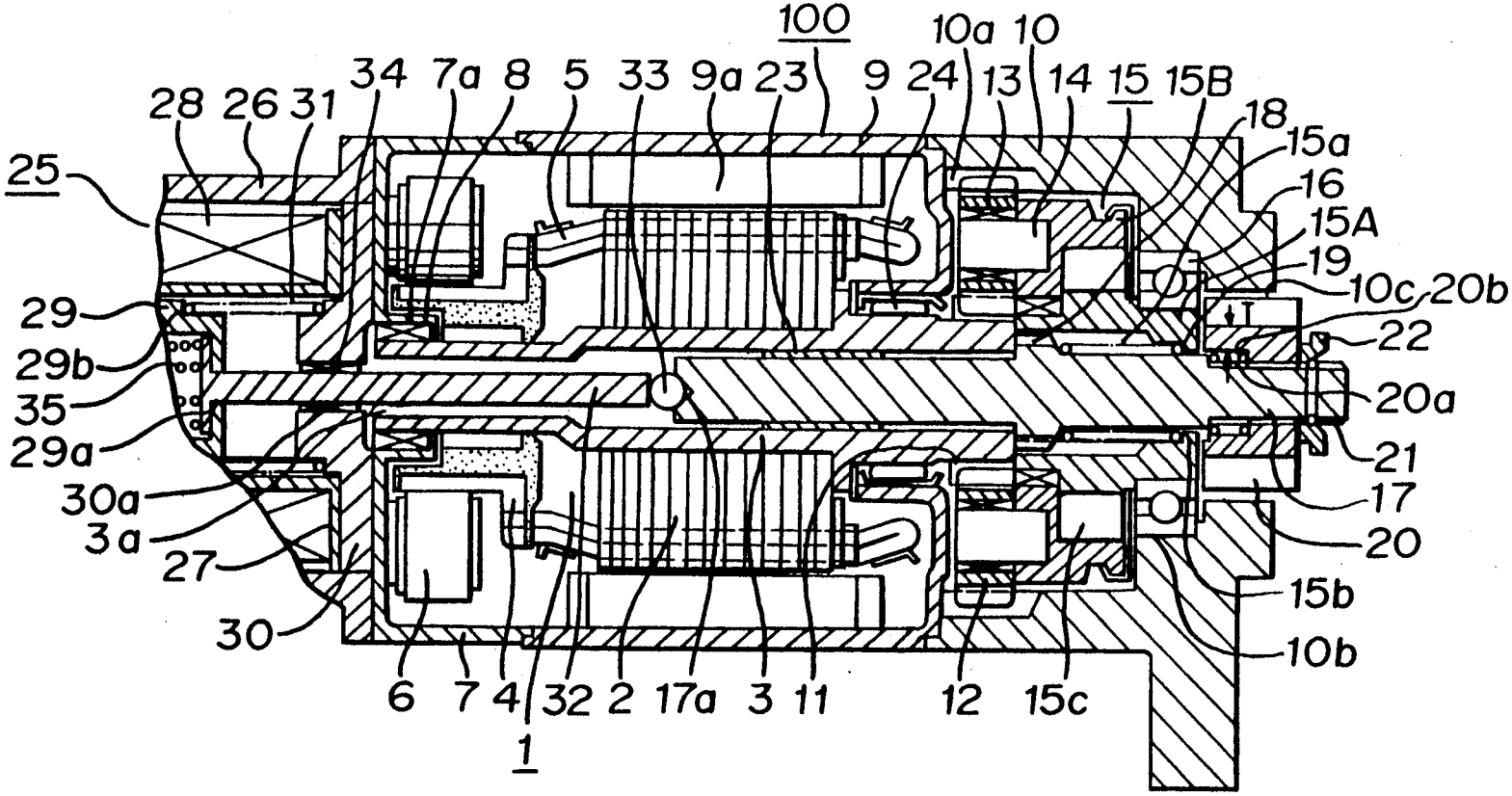
FIGURE 3 PRIOR ART
FIG. 3 is a longitudinal cross-sectional view partly broken of a conventional starter motor.

In FIG. 1, a reference numeral 101 designates an armature as a part of a starter motor 100*a*, which comprises an armature core 102, an armature rotary shaft 103 in a tubular form which supports the armature core 102, a commutator (not shown) and an armature coil 105. In FIG. 1, the structural elements located in the rear portion of the armature 101, which are not shown in cross-section, are the same as those in FIG. 3, and description of these parts is omitted.

A sun gear 107 is formed at the front portion of the armature rotary shaft 103, which constitutes a planetary reduction gear device in association with planetary gear wheels 108 and an internal gear wheel 108. A numeral 106 designates a yoke and a plurality of permanent magnets 106*a* are attached to the inner circumferential surface of the yoke 106. A bearing 110 is fitted to a bent portion which is formed by bending the front portion of the yoke 106, the bearing supporting the armature rotary shaft 103. A plurality of pins 108*a* are fixed to a carrier 123 so as to support the planetary gear wheels 108 through bearings. A bearing 111 is interposed between the inner surface of the carrier 123 and the outer circumference of the front end of the armature rotary shaft 103, the sun gear wheel 107 being formed adjacent the place where the bearing 111 is placed. The bearing 111 functions to keep the carrier 123 and the planetary gear wheels 108 in a coaxial manner.

A clutch outer member 112, rollers 113 and a clutch inner member 114 constitute an overrunning clutch device. In this embodiment, the carrier 123 and the clutch outer member 112 are joined, for instance, by press-fitting so that there occurs slipping at a predetermined torque and an abnormal shock is reduced.

A helical spline 114*b* is formed at the inner circumferential surface of the front portion 114*a* of the clutch inner member 114. On the other hand, a helical spline 115*a* is formed at an outer circumferential portion of the rotary output shaft 115. The both helical splines 114*b*, 115*a* are engaged with each other by helical-spline-fitting with a small clearance so that the outer diameter portions of the both helical splines support each other.

A numeral 115*b* designates the rear end of the helical spline which limits the movement of the rotary output shaft 115 by the contact of the end portion 114*c* of the helical spline 115*b* of the clutch inner member 115 when the rotary output shaft 115 is moved forwardly. A spring 116 for applying a returning force to the rotary output shaft 115 is interposed between a shoulder portion 114*d* formed at the inner circumference of the clutch inner member 114 and a shoulder portion 115*c* as an increased diameter portion formed at the rotary output shaft 115. A bearing 117 is interposed between a housing 118 in which the internal gear wheel 109 is formed and the outer circumference of the front portion of the clutch inner member 114 to thereby support the clutch inner member 114.

A numeral 119 designates a pinion having, for instance, seven teeth (M2.54) which has a straight spline to be fitted to a straight spline 115*g* formed at the outer circumference of the front end portion of the rotary output shaft 115. A numeral 120 designates a retaining ring and a numeral 121 designates a stopper which functions to retain the pinion 119 on the rotary output shaft 115.

After the pinion 119 has been fitted to the rotary output shaft 115 by means of the straight spline structure, the ring 120 and the stopper 121 are to be attached to the shaft. In order to facilitate assembling work for the ring 120 and the stopper 121, a space should be formed between the rear shoulder portion 119*b* of the pinion 119 and a shoulder portion 115*d* as a reduced diameter portion which is formed at an outer circumferential portion of the rotary output shaft 115 so that the pinion 119 can be moved backwardly. A spring 130 is interposed between a shoulder portion 115*f* having a diameter smaller than the diameter of the bottom portion of the helical spline 115*a* of the rotary output shaft 115 and the rear end surface 119*c* of the pinion 119, and inside the front end 114*a* of the clutch inner member 114 so that the pinion 119 is always pushed forwardly for the distance in the axial direction of the space. A flange portion 119*a* is formed at the rear end portion of the pinion 119 to provide the rear end surface 119*c*; to prevent dust from entering toward the clutch inner member 114, and to increase the strength of the pinion 119.

A front bracket 126 is attached to the housing 118 having the internal gear wheel 109 by means of bolts 122, the front bracket being connected to the engine.

An electromagnetic switch 125 is attached to the rear of the motor section, and a plunger rod (not shown) in the electromagnetic switch extends in the motor section so that the rotary output shaft 115 is driven through the armature rotary shaft 103.

The helical spline 115*a* of the rotary output shaft 115 is meshed with the helical spline 114*b* of the clutch inner member 115 with a small clearance so that the rotary output shaft 115 does not vibrate due to the vibration of the engine in a non-operating state. Especially, the spring 130 is positioned at a portion inside the clutch inner member 114 so as not to interfere with the helical spline 114*b*. With such arrangement, the number of teeth of the pinion 119 can be reduced because it is not necessary to form a concave portion for receiving therein a spring, in the inner space of the pinion 119 as the conventional starter motor.

The operation of the above-mentioned embodiment is basically same as that in the conventional starter motor, and description of the operation of this embodiment is omitted.

Figure 2:
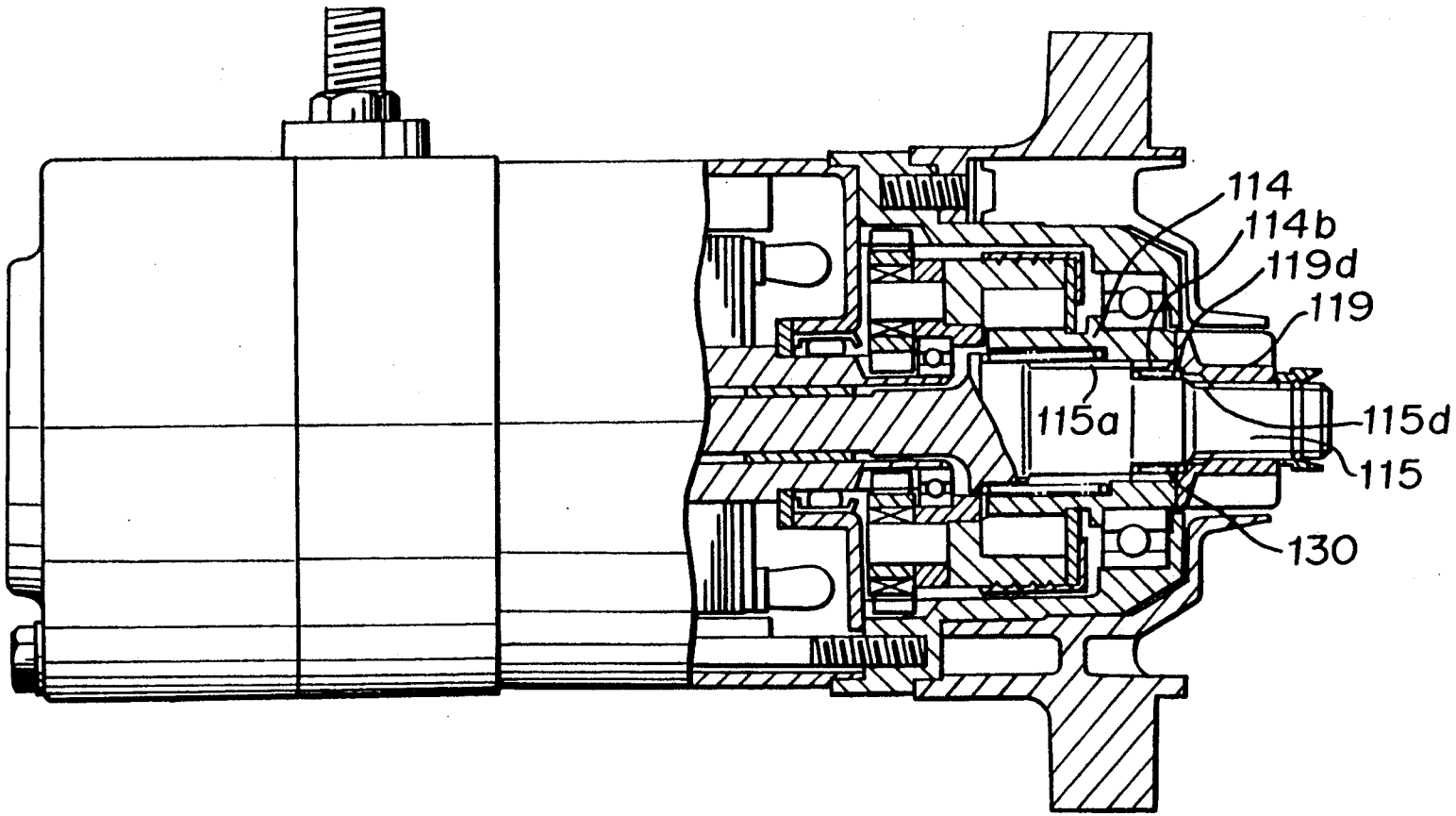
FIG. 2 is a front view partly cross-sectioned in the longitudinal direction of another embodiment of the starter motor according to the present invention.

FIG. 2 shows another embodiment of the starter motor of the present invention. A small recess 119*d* may be formed in the pinion so that the recess 119*d* is used as a guide for the spring 130 as far as the recess does not cause the interference of the spring with the helical spline 114 and the recess 119*d* does not impair the strength of the pinion 119.

Description has been made as to a starter motor having a planetary reduction gear device. However, the present invention is applicable to such a starter motor that a torque is directly transmitted from the armature rotary shaft to the overrunning clutch device.

Further, the starter motor described above is of a type that the permanent magnets are attached to the yoke to produce a magnetic field in the motor. However, a motor having such construction that an iron core with coils is attached to the yoke may be used.

Description has been made as to a coaxial type starter wherein the electromagnetic switch is attached to the rear of the motor to slidably move the rotary output shaft. However, a starter of another type may be used instead of the coaxial type starter. Namely, such a starter that an electromagnetic switch is arranged in parallel to a motor section and a lever operable in association with the movable rod of the electromagnetic switch pushes the rotary output shaft, or an inertia sliding type starter motor, which dispenses with the need for an electromagnetic switch, may be used. Thus, in accordance with the present invention, it is unnecessary to form a recess in the pinion. Accordingly, the number of teeth of the pinion can be reduced in comparison with the conventional technique without reducing the strength of the bottom portion of the teeth of the pinion. This increases flexibility in designing starter motors, and a gear ratio of a pinion to a ring gear can be increased, whereby the size and the weight of a motor section can be reduced. Further, a supporting point for the rotary output shaft is given to the front end portion of a clutch inner member. Accordingly, the rotary output shaft can be stably supported, noises can be reduced, and quality of a starter motor is improved.

Obviously, numerous modifications and variations of the present invention are possible in light of the above teachings. It is therefore to be understood that within the scope of the appended claims, the invention may be practiced otherwise than as specifically described herein.

What is claimed is:

1. A starter motor adapted to transmit through an overrunning clutch device a rotating force of an armature to a rotary output shaft to which a pinion having a plurality of teeth is fitted by means of a linear spline structure, characterized in that the rotary output shaft has a shoulder portion between a helical spline portion, which is engaged with a helical spline which in turn is formed at the inner circumference of the front part of a clutch inner member in the overrunning clutch device, and a linear spline portion to which the pinion is fitted, said shoulder portion having a diameter smaller than the diameter of the root of the helical spline of the rotary output shaft, and a spring disposed and axially between the helical spline of the rotary output shaft and the rear end face of the pinion so that the pinion is pushed forwardly, substantially the entire axial length of said spring being surrounded by said helical spline of said clutch inner member.

2. The starter motor according to claim 1, wherein the spring is interposed between a reduced diameter portion formed adjacent the front end of the helical spline of the rotary output shaft and a flange portion formed at the rear end face of the pinion, said flange portion extending radially outwardly to an outer extent of said plurality of teeth of the pinion.

3. The starter motor according to claim 2, wherein an annular recess is formed in the flange portion of the pinion so as to receive only the front end of the spring, said annular recess being small compared to an axial thickness of the pinion.

* * * * *